US008863786B2

(12) United States Patent
Hosoda et al.

(10) Patent No.: US 8,863,786 B2
(45) Date of Patent: Oct. 21, 2014

(54) PROPELLANT FILLING DEVICE

(75) Inventors: Takafumi Hosoda, Chiyoda-ku (JP); Yoshikazu Iuchi, Chiyoda-ku (JP); Nobuyuki Hanai, Chiyoda-ku (JP); Takuo Shibata, Chiyoda-ku (JP)

(73) Assignee: Toyo Aerosol Industry Co., Ltd., Tokyo (JP)

( * ) Notice: Subject to any disclaimer, the term of this patent is extended or adjusted under 35 U.S.C. 154(b) by 273 days.

(21) Appl. No.: 13/496,078

(22) PCT Filed: Mar. 10, 2010

(86) PCT No.: PCT/JP2010/001688

§ 371 (c)(1), (2), (4) Date: Mar. 14, 2012

(87) PCT Pub. No.: WO2011/070690

PCT Pub. Date: Jun. 16, 2011

(65) Prior Publication Data

US 2012/0168027 A1 Jul. 5, 2012

(30) Foreign Application Priority Data

Dec. 9, 2009 (JP) ..... 2009-279057

(51) Int. Cl.
*B65B 31/04* (2006.01)
*B65B 31/00* (2006.01)

(52) U.S. Cl.
CPC ..... *B65B 31/003* (2013.01)
USPC ..... 141/20; 141/3

(58) Field of Classification Search
USPC ..... 53/467, 470; 141/3, 20, 346, 347, 348, 141/349
See application file for complete search history.

(56) References Cited

U.S. PATENT DOCUMENTS

| | | | | | |
|---|---|---|---|---|---|
| 2,947,511 | A | * | 8/1960 | McInnes | 251/203 |
| 3,219,069 | A | * | 11/1965 | Kuffer | 141/20 |
| 3,310,078 | A | * | 3/1967 | Barrett et al. | 141/348 |
| 3,319,669 | A | * | 5/1967 | Abplanalp | 141/20 |
| 3,402,747 | A | * | 9/1968 | Tissot-Dupont | 141/348 |
| 3,550,649 | A | * | 12/1970 | Meshberg | 141/3 |
| 3,556,171 | A | * | 1/1971 | Gangwisch et al. | 141/3 |
| 3,642,035 | A | * | 2/1972 | Marand | 141/20 |
| 3,718,165 | A | * | 2/1973 | Grothoff | 141/20 |

(Continued)

FOREIGN PATENT DOCUMENTS

| | | |
|---|---|---|
| GB | 2 236 146 | 3/1991 |
| JP | 2-127222 | 5/1990 |

(Continued)

*Primary Examiner* — Timothy L Maust
*Assistant Examiner* — Andrew Schmid
(74) *Attorney, Agent, or Firm* — Jordan and Hamburg LLP

(57) ABSTRACT

A propellant filling device that reliably fills a prescribed amount of propellant into an aerosol container without variations in amount while also preventing backflow to a supply unit side even when the pressure in the aerosol container is higher than a supply unit side pressure. The propellant filling device includes a valve opening member that continuously presses a valve to open a valve system. On the upper end side of the valve opening member, a flow conduit is provided. A valve member in the flow conduit allows a flow channel of the flow conduit to be closed. The valve system is kept in an open state. When the pressure in the aerosol container is higher than the supply unit side pressure, the propellant flows into the aerosol container with backflow of aerosol content being prevented.

3 Claims, 8 Drawing Sheets

(56) References Cited

U.S. PATENT DOCUMENTS

| | | | | |
|---|---|---|---|---|
| 3,783,576 | A * | 1/1974 | Riesenberg et al. | 53/403 |
| 3,812,645 | A * | 5/1974 | Remane | 53/470 |
| 3,825,374 | A * | 7/1974 | Kondo | 417/413.1 |
| 4,072,162 | A * | 2/1978 | Bellehache et al. | 137/71 |
| 4,442,875 | A * | 4/1984 | Genbauffe et al. | 141/348 |
| 4,651,503 | A * | 3/1987 | Anderson et al. | 53/440 |
| 4,727,914 | A * | 3/1988 | Anderson et al. | 141/105 |
| 4,919,564 | A * | 4/1990 | Neathery et al. | 404/25 |
| 5,037,001 | A * | 8/1991 | Presant | 222/1 |
| 5,112,027 | A * | 5/1992 | Hanyu et al. | 251/331 |
| 5,217,139 | A * | 6/1993 | Miczka et al. | 220/495.01 |
| 5,345,980 | A * | 9/1994 | Burt et al. | 141/3 |
| 5,400,920 | A * | 3/1995 | Barnhart | 222/1 |
| 5,647,408 | A | 7/1997 | Erste et al. | |
| 5,878,798 | A * | 3/1999 | Harris et al. | 141/346 |
| 5,915,598 | A * | 6/1999 | Yazawa et al. | 222/402.1 |
| 6,092,566 | A * | 7/2000 | Yazawa et al. | 141/20 |
| 6,196,275 | B1 * | 3/2001 | Yazawa et al. | 141/3 |
| 6,196,276 | B1 * | 3/2001 | De Laforcade | 141/20 |
| 6,848,601 | B2 * | 2/2005 | Greer, Jr. | 222/136 |
| 7,124,788 | B2 * | 10/2006 | Pericard | 141/20 |
| 7,523,767 | B2 * | 4/2009 | Pericard | 141/10 |
| 7,730,911 | B2 * | 6/2010 | Pericard | 141/20 |
| 7,779,609 | B2 * | 8/2010 | Py | 53/426 |
| 8,002,000 | B2 * | 8/2011 | Pericard | 141/20 |
| 8,479,779 | B2 * | 7/2013 | Behar | 141/3 |
| 8,550,425 | B1 * | 10/2013 | Gilstad et al. | 251/64 |
| 2004/0003864 | A1 * | 1/2004 | Bloome et al. | 141/20 |
| 2004/0211481 | A1 * | 10/2004 | Garcia et al. | 141/20 |
| 2004/0216802 | A1 * | 11/2004 | O'Connor et al. | 141/1 |
| 2005/0005995 | A1 * | 1/2005 | Pericard | 141/20 |
| 2006/0278301 | A1 * | 12/2006 | Greer et al. | 141/20 |
| 2008/0206161 | A1 * | 8/2008 | Tamarkin et al. | 424/45 |
| 2008/0272323 | A1 * | 11/2008 | Abe | 251/149.1 |
| 2009/0120445 | A1 * | 5/2009 | Chikashige | 128/207.15 |
| 2010/0266934 | A1 * | 10/2010 | Takahashi et al. | 429/515 |
| 2011/0180569 | A1 * | 7/2011 | Monzel | 222/400.7 |
| 2012/0168027 | A1 * | 7/2012 | Hosoda et al. | 141/20 |
| 2013/0220482 | A1 * | 8/2013 | Fuhrig | 141/18 |

FOREIGN PATENT DOCUMENTS

| | | |
|---|---|---|
| JP | 6-011058 | 1/1994 |
| JP | 2006-189147 | 7/2006 |
| JP | 2007-530368 | 11/2007 |

* cited by examiner (a)

(b)

(c)

PROPELLANT FILLING DEVICE

BACKGROUND OF THE INVENTION

The present invention relates to a propellant filling device for use in filling a propellant into an aerosol container through a valve system of the aerosol container.

As devices for use in pressure-filling a propellant into an aerosol container, propellant filling devices such as one disclosed in Japanese Patent Application Laid-Open No. 2007-530368 (hereafter referred to as Patent Document 1) are conventionally used. It is to be noted that Patent Document 1 discloses a propellant filling device adapted to be connected to the stem side of an aerosol container to fill a propellant into a bag in the aerosol container through an ejection hole of the stem.

Among such filling devices, a filling device as shown in FIG. 8 is conventionally used as a filling device for use in through-the-valve filling, which is a general method for filling a propellant. The filling device shown in FIG. 8 is intended to be used with a general aerosol container (50) having a valve system (55) and a stem (51) whose lower end is pre-fitted to the inside of a housing of the valve system (55). As shown in FIG. 8, the filling device is connected to the stem (51)-projecting side of the aerosol container (50), which is pre-filled with aerosol content composed of a liquid concentrate and propellant, and pressurized propellant is fed into the aerosol container (50) through a supply channel (52) that communicates with a supply unit (not shown). This makes it possible to, by means of the propellant pressure, depress the stem (51) and elastically deform a stem gasket (54) inwardly to fill the propellant into the aerosol container (50) via an ejection hole (53) of the stem (51) and the stem gasket (54).

In the case of such a filling device, when the pressure on the side of the supply unit is higher than the pressure in the aerosol container (50) by a certain value or more, the stem (51) is depressed by the pressure of the propellant supplied from the supply unit, which makes it possible to open the valve system (55) of the aerosol container (50) to allow the propellant to flow from the supply unit side to the aerosol container (50) side. On the other hand, when the pressure in the aerosol container (50) becomes higher than the supply unit side pressure, it becomes difficult for the pressure of the propellant supplied from the supply unit to depress the stem (51), and therefore the valve system (55) of the aerosol container (50) closes, which makes it possible to prevent the backflow of the propellant from the aerosol container (50) side to the supply unit side. Therefore, when such a conventional filling device is used to fill propellant into the aerosol container (50) containing an aerosol content composed of the propellant and a liquid concentrate previously pressure-filled thereinto, backflow of the aerosol content contained in the aerosol container (50) previously filled thereinto can be prevented.

Further, when a water- or alcohol-based liquid concentrate having relatively low viscosity is packed in the aerosol container (50), the contact area between the propellant and the liquid concentrate can be increased by shaking the aerosol container (50) due to good flowability of the liquid concentrate. This makes it possible to easily dissolve the propellant in the liquid concentrate. Therefore, the filling device can effectively fill the propellant into the aerosol container (50).

SUMMARY OF THE INVENTION

However, when a liquid concentrate having relatively high viscosity, such as a foaming agent, is previously packed in the aerosol container (50), it is difficult to agitate the liquid concentrate due to its poor flowability even when the aerosol container (50) is shaken during filling of the propellant into the aerosol container (50). Therefore, the contact area between the propellant and the liquid concentrate cannot be increased even by such shaking of the aerosol container (50), which makes it difficult to promote the dissolution of the propellant in the liquid concentrate during filling of the propellant into the aerosol container (50). Further, when a filling device such as disclosed in Patent Document 1 is used to fill a propellant into an aerosol container containing such a liquid concentrate poor in flowability, the stem (51) of the aerosol container (50) is depressed by the pressure of the propellant supplied from the supply unit against the biasing force of a spring (57), and therefore the pressure of the propellant filled into the aerosol container (50) is significantly reduced by the resistance of the spring (57) or the stem gasket (54) before the propellant reaches the surface of the liquid concentrate contained in the aerosol container (50). Therefore, it is difficult to promote the dissolution of the propellant in the liquid concentrate not only by the above-described shaking of the aerosol container (50) but also by the pressure of the propellant supplied from the supply unit.

Therefore, when the above conventional filling device is used to fill a propellant into the aerosol container (50) containing a liquid concentrate with relatively high viscosity previously packed therein, the propellant is less likely to be dissolved in the liquid concentrate as compared to a case where a liquid concentrate having relatively low viscosity is packed in the aerosol container (50), and the propellant that is filled into the aerosol container (50) but cannot be dissolved in the liquid concentrate is directly accumulated in a head space (56) of the aerosol container (50) so that the pressure in the aerosol container (50) becomes higher as compared to a case where a low-viscosity liquid concentrate is packed in the aerosol container (50).

Further, the pressure required to depress the stem (51) varies from aerosol container (50) to aerosol container (50) but is about 0.6 MPa or higher on average. Therefore, in order to depress the stem (51) by means of the pressure of the propellant supplied from the supply unit, the pressure of the propellant supplied from the supply unit needs to be higher than the pressure in the aerosol container (50) by at least about 0.6 MPa. When the supply unit side pressure becomes lower than the pressure in the aerosol container (50) plus about 0.6 MPa, it becomes difficult to depress the stem (51) by the pressure of the propellant supplied from the supply unit, and therefore the valve system (55) closes, which makes it impossible to fill the propellant into the aerosol container (50).

Therefore, when a conventional filling device such as disclosed in Japanese Patent Application Laid-Open No. 2007-530368 is used to fill a propellant into the aerosol container (50), the pressure of the propellant supplied from the supply unit needs to be higher than the sum of the high pressure in the aerosol container (50) and the pressure required to depress the stem (51). In the case of impact filling performed by previously packing a prescribed amount of propellant in the supply unit, the amount of the propellant contained in the supply unit is gradually reduced by filling the propellant into the aerosol container (50), and therefore, in the final stage of filling of the propellant into the aerosol container (50), the pressure of the propellant supplied from the supply unit becomes lower than the sum of the high pressure in the aerosol container (50) and the pressure required to depress the stem (51). At this point, the valve system (55) of the aerosol container (50) is closed, and therefore filling of the propellant into the aerosol container (50) is finished while the propellant with a pressure slightly lower than the sum of the high pressure in the aerosol container (50) and the pressure required to depress the stem (51) remains on the supply unit side. Therefore, it is difficult to reliably fill a prescribed amount of the propellant into the aerosol container (50).

Also in the case of equilibrium pressure filling in which a propellant is filled into the aerosol container (50) under an equilibrium pressure by shaking the aerosol container (50) to dissolve the propellant in a liquid concentrate contained in the aerosol container (50), as in the case of the above-described impact filling, the pressure of the propellant supplied from the supply unit needs to be higher than the sum of the high pressure in the aerosol container (50) and the pressure required to depress the stem (51) to fill the propellant into the aerosol container (50). Therefore, it is difficult to reliably fill a prescribed amount of the propellant into the aerosol container (50).

Further, as described above, the pressure required to depress the stem (51) conventionally varies from aerosol container (50) to aerosol container (50) due to a difference in the biasing force of the spring (57) that biases the stem (51) upward or a difference in the fitting conditions of the spring (57). Therefore, the supply unit side pressure required to open the valve system (55) during filling of a propellant into the aerosol container (50), that is, the sum of the pressure in the aerosol container (50) and the pressure required to depress the stem (51) varies from aerosol container (50) to aerosol container (50). When a propellant is filled into the aerosol containers (50) different in the pressure required to open their valve systems (55), the supply unit side pressure at the time when the valve system (55) is closed during the completion of feeding varies from aerosol container (50) to aerosol container (50). Therefore, even when the amount of the propellant packed in the supply unit before filling is the same, a situation occurs in which the amount of the propellant remaining on the supply unit side at the time when the valve system (55) is closed varies from aerosol container (50) to aerosol container (50). This causes variations in the amount of the propellant filled into the aerosol container (50), and the range of variation in the amount of the propellant filled into the aerosol container (50) is as wide as 10% or more.

In order to solve the above problems, it is an object of the present invention to provide a propellant filling device which can reliably fill a prescribed amount of propellant into an aerosol container without variations in the amount of the propellant filled into the aerosol container not only when a liquid concentrate having relatively low viscosity is used but also when a liquid concentrate having high viscosity is used, and which can prevent the backflow of propellant from an aerosol container side to a supply unit side even when the pressure in the aerosol container becomes higher than pressure on the supply unit side.

In order to achieve the above object, the present invention is directed to a propellant filling device for filling a propellant into an aerosol container, which contains a liquid concentrate and the propellant previously filled thereinto, through a valve system provided in the aerosol container. It is to be noted that examples of a general method for filling a propellant into an aerosol container include: one in which only a liquid concentrate is previously filled into an aerosol container and then a propellant is filled into the aerosol container at one time; and one in which a liquid concentrate and less than a prescribed amount of propellant are previously filled into an aerosol container and then only the propellant is again filled into the aerosol container until the amount of the propellant in the aerosol container reaches the prescribed amount. The present invention is based on the premise that the latter filling method is used.

The filling device according to the present invention includes a valve opening member provided in the lower end portion thereof so as to face the valve system of the aerosol container to continuously press a valve member of the valve system to open the valve system, and the valve opening member has a communicating hole that is able to communicate with the inside of the aerosol container when the valve system is opened. In this way, by providing the valve opening member that continuously presses the valve member of the valve system to open the valve system, it is possible to mechanically depress a stem by the valve opening member during use to keep the valve system of the aerosol container in an open state.

Unlike the conventional filling device that opens the valve system by the pressure of a propellant supplied from the supply unit, the filling device according to the present invention mechanically opens the valve system in such a manner as described above, and therefore can pressure-fill the propellant into the aerosol container in a state where a propellant flow channel is previously prepared in the aerosol container by mechanical operation. This makes it possible to reliably pressure-fill a prescribed amount of the propellant supplied from a supply unit into the aerosol container with little resistance of a spring or a stem gasket attached to the stem. Further, as described above, since the propellant supplied from the supply unit can flow through the propellant flow channel without resistance, the supply pressure of the propellant is adequately maintained, and therefore the propellant can flow into the aerosol container without significantly reducing the supply pressure thereof and then impact on the liquid concentrate contained in the aerosol container. This makes it possible to directly transfer the pressure of the propellant supplied from the supply unit to the liquid concentrate and therefore to promote the dissolution of the propellant in the liquid concentrate.

Further, a flow conduit that communicates with the propellant supply unit through a supply channel is provided on the upper end side of the valve opening member. In the flow conduit, a valve member is provided to allow, at times of pressurized flow of propellant from the supply unit to the aerosol container, the flow channel of the flow conduit to be opened by the pressure of the propellant, and to allow, at times of pressurized flow from the aerosol container to the supply unit side, the flow channel of the flow conduit to be closed by the pressure in the aerosol container.

Here, when the valve system of the aerosol container is mechanically opened by pressing by the valve opening member in such a manner as described above, the propellant and the liquid concentrate previously filled into the aerosol container flow back to the supply unit side when an aerosol container side pressure is higher than a supply unit side pressure. In this case, there is a possibility that the liquid concentrate adheres to the inside of the supply channel due to the backflow of the propellant and the liquid concentrate. Further, there is also a possibility that the liquid concentrate adhering to the inside of the supply channel causes a disadvantage that, when the aerosol container is detached from the filling device, the liquid concentrate spatters and adheres to a cover of the aerosol container or the surroundings of the filling device.

However, as described above, the filling device according to the present invention is provided with the valve member, and therefore when the aerosol container side pressure becomes higher than the supply unit side pressure, for example just after the valve system is opened, the flow channel provided in the flow conduit is closed by the valve member by the pressure of the propellant that flows back from the aerosol container. That is, the valve member enables to reliably prevent backflow of the propellant to the supply unit side. Therefore, it is possible to avoid inconveniences such as liquid concentrate adhering to the inside of the supply channel due to backflow of aerosol content, causing spattering of the liquid concentrate.

The valve system of the aerosol container is kept in an open state by continuously pressing the valve member of the aerosol container by the valve opening member. In this open state, when the aerosol container side pressure is higher than the supply unit side pressure, the backflow of aerosol content from the aerosol container to the supply unit side can be prevented by the valve member, and when the supply unit side pressure is higher than the aerosol container side pressure, the propellant can flow from the supply unit into the aerosol container through the valve member and the valve system.

The present invention may be directed to a propellant filling device for filling a propellant into an aerosol container, which contains a liquid concentrate and the propellant previously filled thereinto, through a valve system provided in the aerosol container, including: an annular sealing member placed around an outside of a stem insertion hole, which is provided as an opening in a cover of the aerosol container, so as to be able to cover an outer periphery of a stem projection, which projects outward from the aerosol container, in such a manner that a gap is provided between the sealing member and the stem projection; a valve opening member which is provided on an upper end side of the sealing member so as to be able to depress a stem that is a valve member according to the present invention and which has a communicating hole that communicates with an inside of the aerosol container; a flow conduit which is provided on an upper end side of the valve opening member so as to communicate with a propellant supply unit through a supply channel and which has a valve seat provided on an inner peripheral surface thereof; and a valve member which is provided in the flow conduit and which is, when the propellant flows under pressure from the supply unit to the aerosol container, moved by the pressure of the propellant in such a direction as to separate from the valve seat of the flow conduit to allow a flow channel of the flow conduit to be opened and which is, when the propellant flows under pressure from the aerosol container to the supply unit side, brought into close contact with the valve seat of the flow conduit by the pressure of the propellant to allow the flow channel of the flow conduit to be closed, wherein the sealing member provided around the outside of the stem insertion hole air-tightly connects the valve opening member to the stem insertion hole, and the valve opening member depresses the stem to keep the valve system provided in the aerosol container in an open state, and in this open state, when an aerosol container side pressure is higher than a supply unit side pressure, backflow of aerosol content from the aerosol container to the supply unit side is prevented by the valve member and when the supply unit side pressure is higher than the aerosol container side pressure, the propellant flows from the supply unit into the aerosol container through the valve member and the valve system.

The present invention may be directed to a propellant filling device for filling a propellant into a female valve-type aerosol container, from which a propellant introduction cylinder does not project outward through a stem gasket and which contains a liquid concentrate and the propellant previously filled thereinto, through a valve system provided in the aerosol container, including: an annular sealing member that is able to be placed around an outside of a stem insertion hole provided as an opening in a cover of the aerosol container; a rod-shaped valve opening member inserted into and placed in the sealing member with a gap being provided therebetween so as to be able to pass through the stem insertion hole to press a valve member of the valve system, the valve opening member having a communicating hole that is able to communicate with an inside of the aerosol container when the valve system is opened; a flow conduit which is provided on an upper end side of the valve opening member so as to communicate with a propellant supply unit through a supply channel and which has a valve seat provided on an inner peripheral surface thereof; and a valve member which is provided in the flow conduit and which is, when the propellant flows under pressure from the supply unit to the aerosol container, moved by the pressure of the propellant in such a direction as to separate from the valve seat of the flow conduit to allow a flow channel of the flow conduit to be opened and which is, when the propellant flows under pressure from the aerosol container to the supply unit side, brought into close contact with the valve seat of the flow conduit by the pressure of the propellant to allow the flow channel of the flow conduit to be closed, wherein the sealing member provided around the outside of the stem insertion hole of the aerosol container air-tightly connects the valve opening member to the stem insertion hole, and the valve opening member presses the valve member of the aerosol container to keep the valve system provided in the aerosol container in an open state, and in this open state, when an aerosol container side pressure is higher than a supply unit side pressure, backflow of aerosol content from the aerosol container to the supply unit side is prevented by the valve member and when the supply unit side pressure is higher than the aerosol container side pressure, the propellant flows from the supply unit into the aerosol container through the valve member, the communicating hole of the valve opening member, and the valve system.

The flow conduit may be one in which a small flow conduit is provided in the flow conduit in such a manner that a gap is provided between an inner peripheral surface of the flow conduit and the small flow conduit to allow the flow channel of the flow conduit and the communicating hole of the valve opening member to communicate with each other through the small flow conduit, wherein the small flow conduit has a communicating port provided in its side wall so as to communicate with the flow channel and a distal opening covered with the valve member, and wherein, during filling of the propellant from the supply unit into the aerosol container, when the aerosol container side pressure is higher than the supply unit side pressure, the valve member comes into close contact with a valve seat provided on an inner surface of the flow conduit by the aerosol container side pressure to allow the flow channel of the flow conduit to be closed to prevent backflow of the propellant and the aerosol content to the supply unit side, and on the other hand, when the supply unit side pressure is higher than the aerosol container side pressure, the valve member is moved to a small flow conduit side by a pressure of the propellant supplied from the supply unit so that a propellant communication channel is formed between the inner peripheral surface of the flow conduit and the valve member to allow the propellant supplied from the supply unit to flow to an aerosol container side through the valve member and the communicating port.

The valve member may be formed from an elastic member having a bowl shape, and when the aerosol container side pressure is higher than the supply unit side pressure, the valve member may come into close contact with the valve seat of the flow conduit to allow the flow channel of the flow conduit to be closed, and when the supply unit side pressure is higher than the aerosol container side pressure, the valve member may be elastically deformed toward the small flow conduit side to allow a propellant communication channel to be formed between the inner peripheral surface of the flow conduit and the valve member.

Unlike the stem system of an aerosol valve, the valve member is formed from an elastic member without using a spring, and therefore even when the supply unit side pressure is only slightly higher than the aerosol container side pressure, the valve member can be opened to allow the propellant to flow into the aerosol container. Therefore, as compared to the conventional filling device requiring a pressure of at least about 0.6 MPa to depress the stem, the filling device according to the present invention can reduce the minimum pressure of the propellant required to fill the propellant from the supply unit into the aerosol container. That is, the valve system can be opened even when pressure is only slightly higher on the supply unit side, and therefore it is not required to increase the pressure of the propellant more than necessary. As described above, the valve member can be opened without the need to allow the propellant supplied from the supply unit to have high pressure, and therefore a prescribed amount of the propellant can be reliably filled from the supply unit into the aerosol container.

Further, as described above, since the resistance of the valve member during filling of the propellant is very low, the pressure of the propellant supplied from the supply unit is not significantly reduced even after the propellant passes through the stem to flow into the aerosol container. Therefore, the propellant supplied from the supply unit can be filled into the aerosol container while its supply pressure is adequately maintained, which makes it possible to effectively fill the propellant. Further, the fill pressure of the propellant is not reduced by the spring or the stem gasket attached to the stem, and therefore the propellant can reach the surface of the liquid concentrate contained in the aerosol container while its supply pressure is adequately maintained. Therefore, the dissolution of the propellant in the liquid concentrate can be promoted by the fill pressure of the propellant.

Alternatively, the valve member may have a flat plate shape, and when the aerosol container side pressure is higher than the supply unit side pressure, the valve member may come into close contact with the valve seat of the flow conduit to allow the flow channel of the flow conduit to be closed, and when the supply unit side pressure is higher than the aerosol container side pressure, the valve member may be moved to the small flow conduit side to allow a propellant communication channel to be formed between the inner peripheral surface of the flow conduit and an outer periphery of the valve member.

The propellant filling device according to the present invention having such a structure as described above can keep the valve system provided in the aerosol container in an open state by pressing the stem by the valve opening member, and therefore can pressure-fill the propellant in a state where a propellant flow channel is previously prepared in the aerosol container. Therefore, unlike the conventional filling device, the filling device according to the present invention can reliably fill a prescribed amount of the pressurized propellant, supplied from the supply unit, into the aerosol container with little resistance of the spring or the stem gasket attached to the stem. Further, as described above, the propellant supplied from the supply unit flows into the aerosol container while its supply pressure is maintained, and then impacts on the liquid concentrate contained in the aerosol container, and therefore the pressure of the propellant directly transfers to the liquid concentrate. This makes it possible to promote the dissolution of the propellant in the liquid concentrate and therefore to effectively fill the propellant from the supply unit into the liquid concentrate.

Further, when the propellant flows under pressure from the supply unit to the aerosol container, the valve member is moved by the pressure of the propellant so that the flow channel can be opened, and when the propellant flows under pressure from the aerosol container to the supply unit side, the flow channel can be closed by the valve member. Therefore, even when the aerosol content contained in the aerosol container flows back, the flow channel is sealed with the valve member by the pressure of the propellant that flows back from the aerosol container, which makes it possible to prevent the backflow of the aerosol content to the supply unit side. Therefore, a situation that the liquid concentrate that flows back from the aerosol container adheres to the inside of the supply channel is less likely to occur, thereby avoiding the disadvantage that, when the aerosol container is detached from the filling device, the liquid concentrate adhering to the inside of the supply channel adheres to the cover of the aerosol container or spatters around the filling device.

DETAILED DESCRIPTION OF THE INVENTION

First Embodiment

Figure 1:
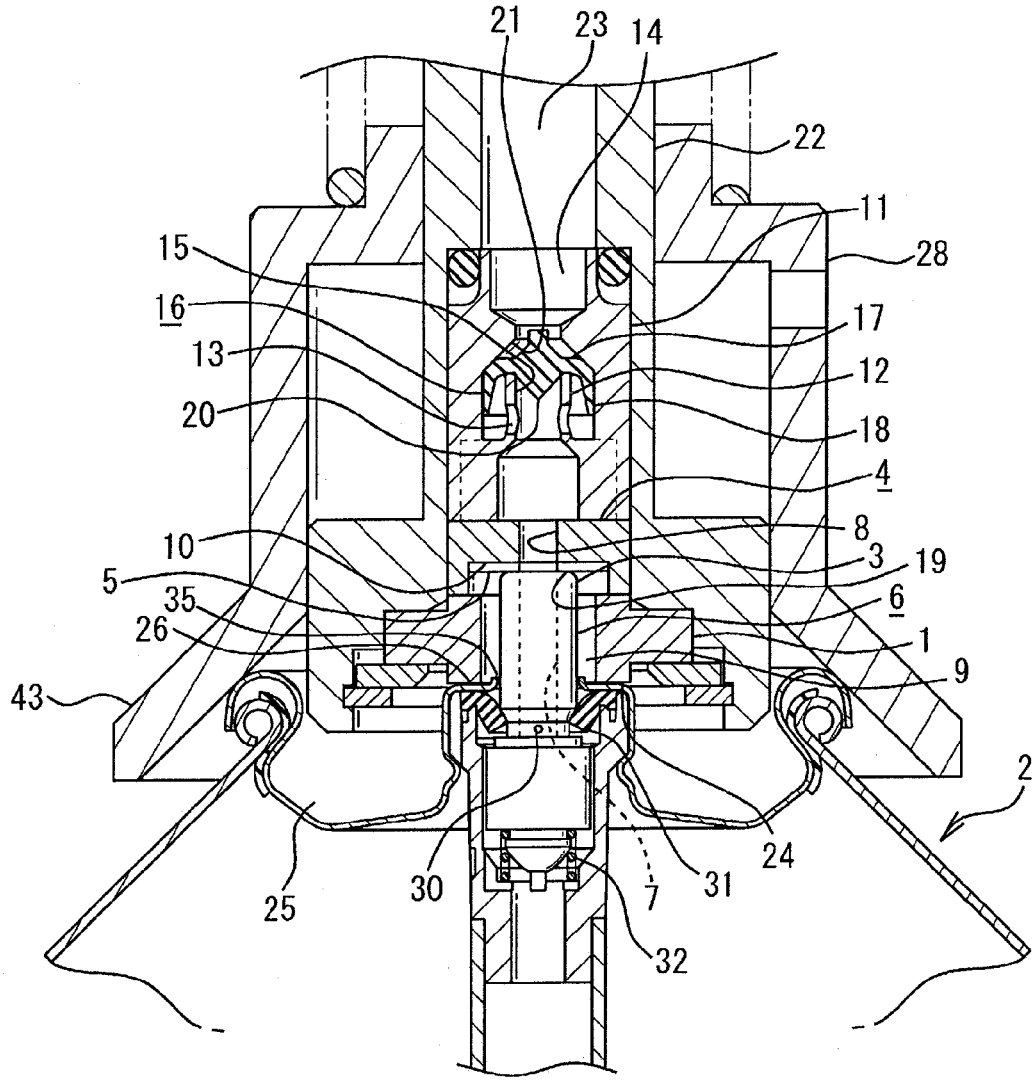
FIG. 1 is a partial sectional view of a first embodiment of the present invention in which an aerosol container side pressure is higher than a supply unit side pressure.
Figure 2:
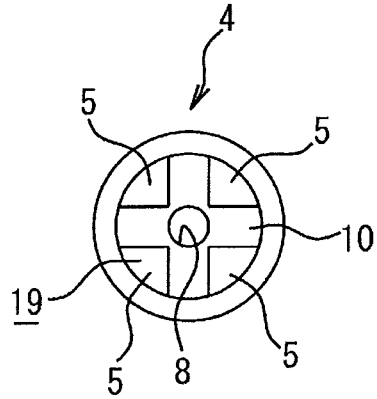
FIGS. 2(*a*) to 2(*c*) are bottom views of valve opening members according to the first embodiment and other variant embodiments of the present invention.
Figure 2:
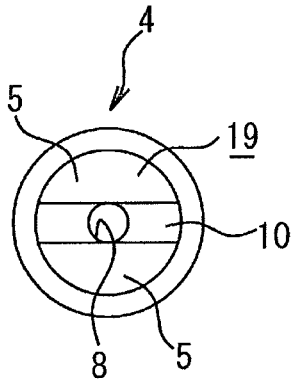
Figure 2:
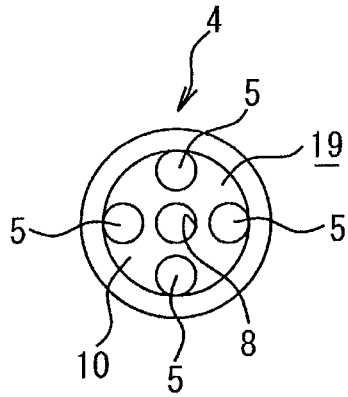
Figure 3:
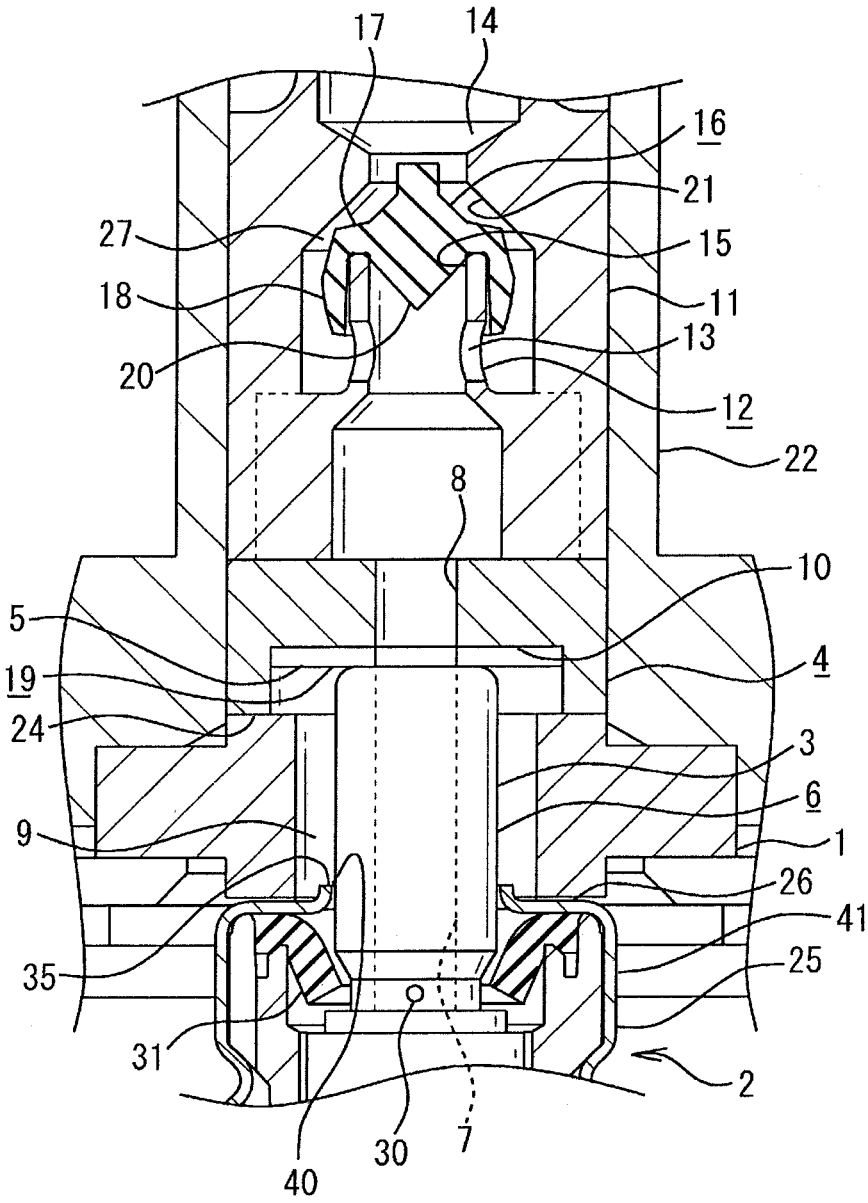
FIG. 3 is a partial sectional view of the first embodiment of the present invention in which the supply unit side pressure is higher than the aerosol container side pressure.

A first embodiment according to the present invention will be described with reference to FIGS. 1 to 3. As shown in FIG. 1, (1) denotes a sealing member having a cylindrical shape, and a stem projection (3) that projects outward from a stem insertion hole (35) provided in the centre of a cover (25) of an aerosol container (2) is inserted into and placed in the sealing member (1), which makes it possible to cover the outer periphery of the stem projection (3). Further, when the stem projection (3) is inserted into and placed in the sealing member (1), a certain gap (9) is provided between the sealing member (1) and the stem projection (3) placed in the sealing member (1). By providing the sealing member (1) in such a manner as described above, it is possible to seal the space between a valve opening member (4) and a flat surface (26) provided in the centre of the cover (25) of the aerosol container (2).

The upper end of the sealing member (1) is connected to the lower end of the valve opening member (4) having a U-shaped cross section, and a ceiling surface (19) of the valve opening member (4) serves as a pressing surface (5). A communicating hole (8) that communicates with an injection hole (7) of a stem (6) that is a valve member according to the present invention is provided in the centre of the valve opening member (4) so as to penetrate the valve opening member (4). Further, as shown in FIG. 2(*a*), two communicating recesses (10), which are continuous with the communicating hole (8), are provided on the ceiling surface (19) of the valve opening member (4) in the direction of the diameter of the ceiling surface (19) so as to intersect in a cross shape. It is to be noted that, according to this embodiment, as shown in FIG. 2(*a*), the number of the communicating recesses (10) provided in the direction of the diameter of the ceiling surface (19) is two, but according to other variant embodiments, as shown in FIG. 2(*b*) the number of the communicating recesses (10) provided in the direction of the diameter of the ceiling surface (19) may be one or, as shown in FIG. 2(*c*) a recess created by forming four circular pressing surfaces (5) on the ceiling surface (19) may be used as the communicating recess (10).

A tubular flow conduit (11) is connected to and placed on the upper surface of the valve opening member (4). In the flow conduit (11), a small flow conduit (12) is provided in coaxial direction with the flow conduit (11). The proximal end of the small flow conduit (12) is integrated with the inner peripheral surface of the flow conduit (11), which makes it possible to allow the inside of the small flow conduit (12) to communicate with the communicating hole (8) of the valve opening member (4). On the other hand, the distal end of the small flow conduit (12) is arranged projecting in axial direction within the tubular flow conduit (11) and spaced apart from the inner peripheral surface of the flow conduit (11). In the projection, two communicating ports (13) are provided through which a flow channel (14) provided in the upper end portion of the flow conduit (11) and the communicating hole (8) of the valve opening member (4) can communicate with each other.

A distal opening (15) of the small flow conduit (12) is covered with a valve member (16) made of a rubber material that is an elastic material. The valve member (16) has a bowl shape formed from a bottom wall (17) and a tapered portion (18) extending from the bottom wall (17) and having a gradually increasing diameter, and an inverted cone-shaped fitting projection (20) is provided in the centre of the bottom wall (17) so as to project from the inner surface of the bottom wall (17). The valve member (16) is provided at the distal opening (15) of the small flow conduit (12) in a state where the fitting projection (20) is inserted into and placed in the distal opening (15) of the small flow conduit (12).

This makes it possible for the tapered portion (18) of the valve member (16) to be located around the outside of the distal opening (15) of the small flow conduit (12). Further, as described above, since the fitting projection (20) of the valve member (16) is placed in the distal opening (15) of the small flow conduit (12), positioning of the valve member (16) can be performed by the fitting projection (20) so that the central portion of the valve member (16) is always located in the distal opening (15). This makes it possible to prevent the misalignment of the valve member (16) and therefore to always maintain the normal function of the valve member (16). Further, as described above, since the valve member (16) is made of a rubber material, the valve member (16) can be elastically deformed even when the pressure of a propellant is very low.

Further, a valve seat (21) for the valve member (16) is provided over the small flow conduit (12). The valve seat (21) annularly projects from the inner peripheral surface of the flow conduit (11). Therefore, when an aerosol container (2) side pressure becomes higher than a supply unit side pressure, the valve member (16) is moved to a valve seat (21) side by the pressure of a propellant exerted on a supply unit side and is elastically deformed so that, as shown in FIG. 1, the valve member (16) comes into close contact with the valve seat (21). This makes it possible to seal the flow channel (14) of the flow conduit (11) with the valve member (16).

Further, a tubular supply conduit (22) is provided around the outside of the sealing member (1), the valve opening member (4), and the flow conduit (11). More specifically, the sealing member (1), the valve opening member (4), and the flow conduit (11) are inserted into and placed in the lower end portion of the supply conduit (22), and a supply channel (23), which communicates with a supply unit, is formed above the flow conduit (11). The supply conduit (22) provided in such a manner as described above is covered with a tubular cover member (28) provided around the outside of the supply conduit (22).

Herein below, a mechanism for filling a prescribed amount of propellant using the filling device having such a structure as described above will be described. First, the stem projection (3) is inserted into the sealing member (1) to connect the aerosol container (2) to the filling device according to the present invention so that a lower end surface (24) of the sealing member (1) abuts against the flat surface (26) of the cover (25) located around the outside of the stem projection (3). It is to be noted that into the aerosol container (2) according to this embodiment, certain amounts of a liquid concentrate and of a propellant have already been filled, with a prescribed amount that is to be filled into the aerosol container (2) additionally being stored in a supply unit (not shown) in advance. According to this embodiment, as described above, the propellant is filled into the aerosol container (2) by impact filling, but according to another embodiment, the propellant may be filled into the aerosol container (2) by so-called equilibrium pressure filling in which the propellant is filled into the aerosol container (2) under an equilibrium pressure while the aerosol container (2) is shaken.

The stem (6) of the aerosol container (2) is pressed by the valve opening member (4) provided on the upper end side of the sealing member (1) by, as described above, connecting the aerosol container (2) to the filling device. It is to be noted that the length of the sealing member (1) in the axial direction thereof is previously adjusted so that the stem (6) is pressed by the pressing surface (5) of the valve opening member (4) by, as described above, allowing the flat surface (26) of the aerosol container (2) to abut against the lower end surface (24) of the sealing member (1). Then, as shown in FIG. 1, an orifice (30) of the stem (6) closed by a stem gasket (31) of the aerosol container (2) is opened by the elastic deformation of the stem gasket (31) by, as described above, pressing the stem (6) by the pressing surface (5) of the valve opening member (4) so that a valve system of the aerosol container (2) is opened.

As described above, the stem (6) can be pressed by the valve opening member (4) by mechanical operation, that is, by connecting the aerosol container (2) to the filling device according to this embodiment. Therefore, unlike the conventional filling device which opens the valve system by pressing the stem (6) only by the pressure of a propellant supplied from the supply unit, even when the liquid concentrate filled into the aerosol container (2) is poor in flowability, a prescribed amount of the propellant can be reliably pressure-filled from the supply unit into the aerosol container (2) in a state where the valve system is mechanically kept in an open state irrespective of the pressure of the propellant supplied from the supply unit or the fact that the pressure required to depress the stem (6) is different from aerosol container (2) to aerosol container (2). Therefore, it is possible to prevent variations in the amount of the propellant contained in the aerosol container (2) after filling of the propellant into the aerosol container (2).

Further, as described above, since the valve system is opened by mechanical operation, the propellant supplied from the supply unit can be filled into the aerosol container (2) with little resistance of a spring (32) or the stem gasket (31). Therefore, the propellant supplied from the supply unit can be brought into contact with the liquid concentrate contained in the aerosol container (2) without significantly reducing the pressure thereof, and the dissolution of the propellant in the liquid concentrate can be promoted by the pressure of the propellant.

As described above, since certain amounts of a propellant and a liquid concentrate are previously filled into the aerosol container (2), the pressure in the aerosol container (2) temporarily becomes higher than the supply unit side pressure just after the valve system is opened, and therefore the propellant and the liquid concentrate contained in the aerosol container (2) flow back to the supply unit side. However, during the backflow, as shown in FIG. 1, the valve member (16) provided in the flow conduit (11) is pressed toward the valve seat (21) side by the pressure of the propellant that flows back from the aerosol container (2) side so that the tapered portion (18) of the valve member (16) is elastically deformed and brought into close contact with the valve seat (21). As a result, the flow channel (14) is sealed with the valve member (16), thereby preventing the backflow of the propellant and the liquid concentrate to the supply unit side through the flow channel (14).

If the valve member (16) used in this embodiment is not provided, the liquid concentrate adheres to the inside of the supply channel (23) or the flow channel (14) due to the backflow of the propellant and the liquid concentrate, which is likely to cause a disadvantage that, when the aerosol container (2) is detached from the filling device, the liquid concentrate adhering to the inside of the supply channel (23) spatters and then adheres to the cover (25) or contaminates the surroundings. However, the filling device according to this embodiment is provided with the valve member (16), and therefore such a disadvantage is less likely to occur.

When the propellant is supplied from the supply unit through the supply channel (23) to the aerosol container (2) side, the propellant supplied from the supply unit passes through the flow channel (14) and abuts against the valve member (16). At this time, when the supply unit side pressure is higher than the pressure in the aerosol container (2) by at least 0.02 MPa, as shown in FIG. 3, the tapered portion (18) of the valve member (16) is elastically deformed toward the small flow conduit (12) side by the supply unit side pressure. As a result of the elastic deformation, a communicating channel (27) is formed between the flow conduit (11) and the valve member (16).

Therefore, the propellant that has been supplied from the supply unit and has passed through the flow channel (14) passes through the valve member (16) and the communicating channel (27) and flows into the small flow conduit (12) through the communicating ports (13) of the small flow conduit (12). Then, the propellant that has flowed into the small flow conduit (12) passes through the communicating hole (8) and the communicating recesses (10) of the valve opening member (4) and flows into the injection hole (7) of the stem (6). Then, the propellant that has flowed into the injection hole (7) of the stem (6) is filled into the aerosol container (2) through the orifice (30) of the stem (6). Further, the propellant that has flowed into the communicating recesses (10) of the valve opening member (4) passes through the gap (9) provided between the sealing member (1) and the stem (6) placed in the sealing member (1) and a gap (40) for fluid communication provided between the stem (6) and the stem insertion hole (35), pushes and opens the stem gasket (31) by its pressure, further passes through the gap between the stem gasket (31) and the stem (6), and is filled into the aerosol container (2).

As described above, the filling device according to this embodiment allows the propellant to flow into the aerosol container (2) when the supply unit side pressure is higher than the aerosol container (2) side pressure by 0.02 MPa or higher. Therefore, as compared to the conventional filling device that requires a difference between the supply unit side pressure and the aerosol container (50) side pressure of at least about 0.6 MPa to depress the stem (51) during filling of the propellant into the aerosol container (50), the filling device according to this embodiment can reduce the minimum pressure of the propellant required to fill the propellant from the supply unit into the aerosol container (2).

Further, as described above, the resistance of the valve member (16) during filling of the propellant into the aerosol container (2) is very weak. Therefore, the pressure of the propellant supplied from the supply unit is not significantly reduced even after the propellant passes through the valve member (16), which makes it possible to fill the propellant into the aerosol container (2) while adequately maintaining the pressure of the propellant. Therefore, it is possible to effectively fill a prescribed amount of the propellant into the aerosol container (2). Further, it is also possible to allow the propellant to impact on the liquid concentrate contained in the aerosol container (2) at high pressure. This makes it possible to, even when a liquid concentrate poor in flowability is used, promote the dissolution of the propellant in the liquid concentrate by the pressure of the propellant. Further, this makes it possible to prevent the pressure in the aerosol container (2) from being significantly increased due to insufficient dissolution of the propellant in the liquid concentrate and therefore to fill the propellant into the aerosol container (2) while maintaining the pressure in the aerosol container (2) at an appropriate level.

Second Embodiment

Figure 4:
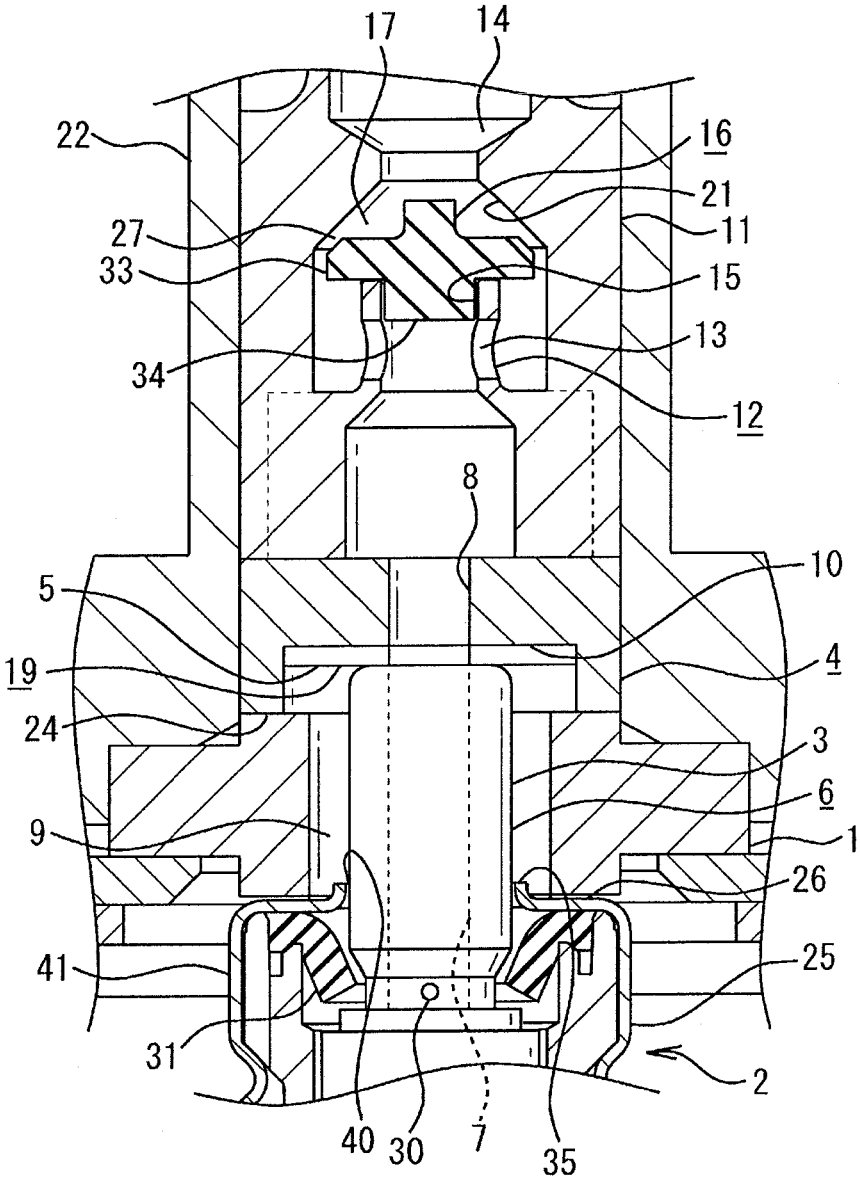
FIG. 4 is a partial sectional view of a second embodiment of the present invention in which a supply unit side pressure is higher than an aerosol container side pressure.

As described above, the valve member (16) according to the first embodiment has a bowl shape formed from the bottom wall (17) and the tapered portion (18) extending from the bottom wall (17) and having a gradually-increasing diameter. However, according to a second embodiment of the present invention, as shown in FIG. 4, the valve member (16) is formed from a flat-shaped plate wall (33). Further, a fitting projection (34) is provided in the centre of the plate wall (33) so as to project from the bottom surface of the plate wall (33). The fitting projection (34) can be fitted into the distal opening (15) of the small flow conduit (12). Therefore, positioning of the valve member (16) can be performed by the fitting projection (34) so that the central portion of the valve member (16) is always located in the distal opening (15).

When the propellant is supplied from the supply unit through the supply channel (23) to the aerosol container (2) side, the propellant supplied from the supply unit passes through the flow channel (14) and abuts against the valve member (16). At this time, when the supply unit side pressure is higher than the pressure in the aerosol container (2), as shown in FIG. 4, the valve member (16) is moved to the small flow conduit (12) side by the supply unit side pressure, and therefore the communicating channel (27) is formed between the flow conduit (11) and the valve member (16).

Therefore, the propellant that has been supplied from the supply unit and has passed through the flow channel (14) passes through the valve member (16) and the communicating channel (27) and flows into the small flow conduit (12) through the communicating ports (13) of the small flow conduit (12). Even when the supply unit side pressure is only slightly higher than the aerosol container (2) side pressure, the communicating channel (27) is formed between the flow conduit (11) and the valve member (16) by the movement of the valve member (16), and therefore, unlike the first embodiment, the propellant can flow into the aerosol container (2) without the need for elastically deforming the valve member (16). This embodiment requires no excess pressure to elastically deform the valve member (16) and therefore can minimize the pressure required to fill the propellant into the aerosol container (2).

As described above, the resistance of the valve member (16) during filling of the propellant into the aerosol container (2) is little. Therefore, the pressure of the propellant supplied from the supply unit is not significantly reduced even after the propellant passes through the valve member, which makes it possible to fill the propellant into the aerosol container (2) while adequately maintaining the pressure of the propellant. Therefore, it is possible to effectively fill a prescribed amount of the propellant into the aerosol container (2). Further, it is also possible to allow the propellant to impact on the liquid concentrate contained in the aerosol container (2) at high pressure. This makes it possible to, even when a liquid concentrate poor in flowability is used, promote the dissolution of the propellant in the liquid concentrate by the pressure of the propellant and therefore to fill the propellant into the aerosol container (2) while maintaining the pressure in the aerosol container (2) at an appropriate level without increasing the pressure in the aerosol container (2) more than necessary.

On the other hand, when the aerosol container (2) side pressure becomes higher than the supply unit side pressure, the valve member (16) is pressed toward the valve seat (21) side by the pressure of the propellant that flows back from the aerosol container (2) side so that the outer periphery of the plate wall (33) of the valve member (16) is brought into close contact with the valve seat (21). This makes it possible to seal the flow channel (14) with the valve member (16), thereby preventing the backflow of the propellant and the liquid concentrate to the supply unit side through the flow channel (14).

Third Embodiment

Each of the above-described propellant filling devices according to the first and second embodiments of the present invention is intended to be used for the aerosol container (2) having a housing and the stem (6) whose lower end portion is inserted into and placed in the housing and whose upper end portion projects outward from the stem insertion hole (35). However, a propellant filling device according to a third embodiment of the present invention and a propellant filling device according to a fourth embodiment of the present invention (which will be described later) are intended to be used for the aerosol container (2) whose stem (6) is not previously fitted thereto, that is, for the aerosol container (2) which has a so-called female-type valve and whose stem (6) is integrally formed with a push button and is connected to the stem insertion hole (35) after the completion of filling of a liquid concentrate and a propellant.

Figure 5:
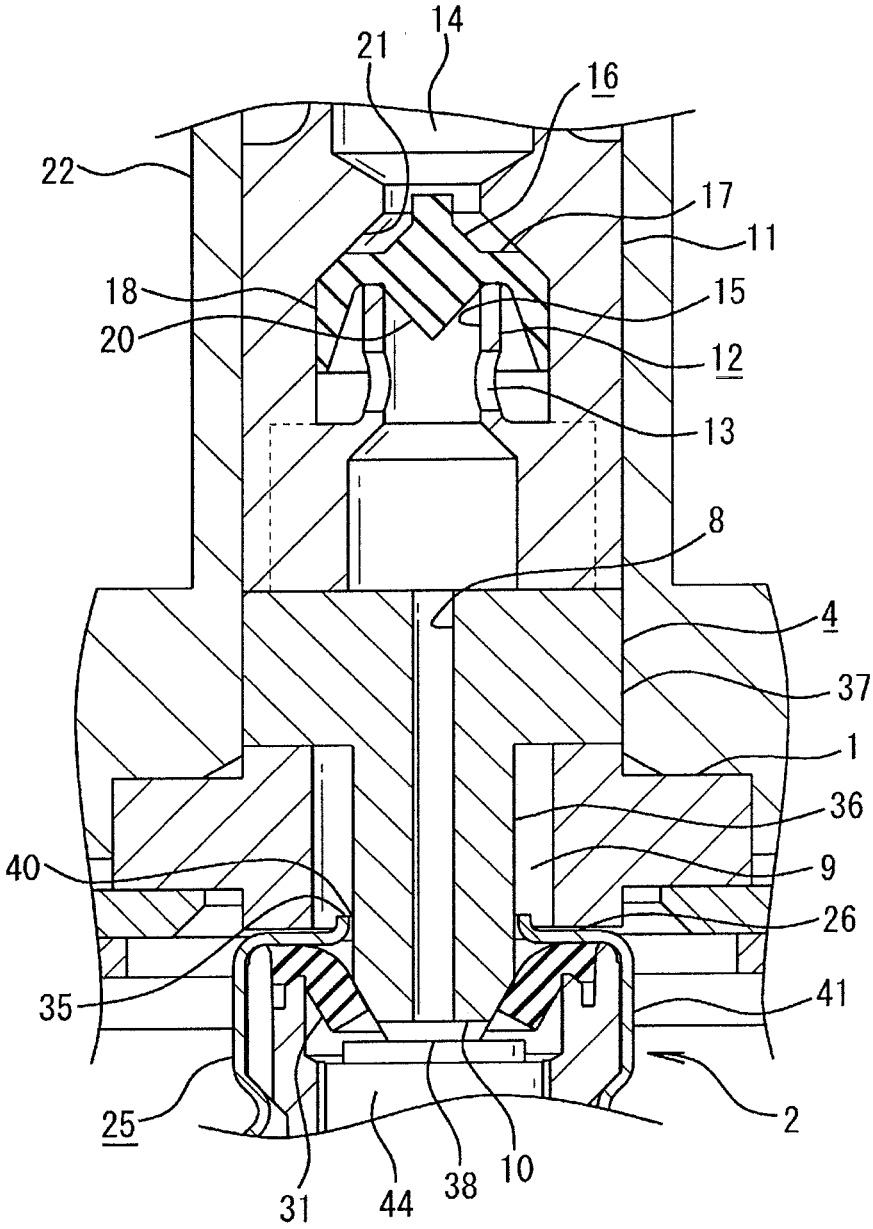
FIG. 5 is a partial sectional view of a third embodiment of the present invention in which an aerosol container side pressure is higher than a supply unit side pressure.

Herein below, the propellant filling device according to the third embodiment of the present invention will be described in detail. As shown in FIG. 5, (1) denotes the sealing member having a cylindrical shape, and the sealing member (1) is placed around the outside of the stem insertion hole (35) provided in the centre of the cover (25) of the aerosol container (2). The valve opening member (4) having a substantially T-shaped cross section is connected to the upper end of the sealing member (1). The valve opening member (4) includes a pressing body (36) having a rod shape and an annular flange (37) provided on the upper end of the pressing body (36). In a state where the pressing body (36) of the valve opening member (4) is inserted into the sealing member (1) so that the gap (9) is provided between the sealing member (1) and the pressing body (36) placed in the sealing member (1), the lower end surface of the annular flange (37) is in close contact with the upper end surface of the sealing member (1) in a circumferential direction.

Figure 6:
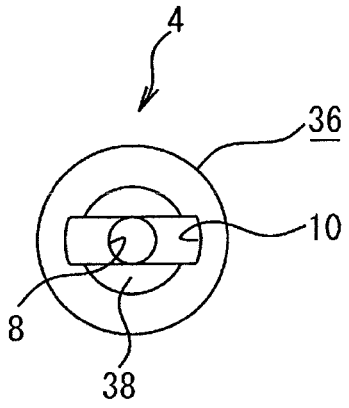
FIG. 6 is a bottom view of a pressing body of a valve opening member according to the third embodiment of the present invention.

By connecting the sealing member (1) and the valve opening member (4) together in such a manner as described above, it is possible to seal the space between the annular flange (37) of the valve opening member (4) and the stem insertion hole (35) of the aerosol container (2) with the sealing member (1). Further, the communicating hole (8) is provided in the centre of the valve opening member (4) in the axial direction of the valve opening member (4) so as to penetrate the valve opening member (4) from its upper end to its lower end. The pressing body (36) of the valve opening member (4) has a tip surface (38). As shown in FIGS. 5 and 6, on the tip surface (38), the communicating recess (10) that communicates with the communicating hole (8) is provided in a direction perpendicular to the communicating hole (8).

Further, the tubular flow conduit (11) is connected to and placed on the upper surface of the valve opening member (4). In the flow conduit (11), the small flow conduit (12) is provided in the coaxial direction of the flow conduit (11). The proximal end of the small flow conduit (12) is integrated with the flow conduit (11), which makes it possible to allow the inside of the small flow conduit (12) to communicate with the communicating hole (8) of the valve opening member (4). On the other hand, the distal end of the small flow conduit (12) is arranged projecting in axial direction within the tubular flow conduit (11) and spaced apart from the inner peripheral surface of the flow conduit (11). In the projection, the two communicating ports (13) are provided, through which the flow channel (14) provided in the upper end portion of the flow conduit (11) and the communicating hole (8) of the valve opening member (4) can communicate with each other.

Further, the distal opening (15) of the small flow conduit (12) is covered with the valve member (16) made of a rubber material that is an elastic material. The valve member (16) has a bowl shape formed from the bottom wall (17) and the tapered portion (18) extending from the bottom wall (17) and having a gradually-increasing diameter, and the inverted cone-shaped fitting projection (20) is provided so as to project from the inner surface of the bottom wall (17). The valve member (16) is provided at the distal opening (15) of the small flow conduit (12) in a state where the fitting projection (20) is inserted into and placed in the distal opening (15) of the small flow conduit (12).

This makes it possible for the tapered portion (18) of the valve member (16) to be located around the outside of the distal opening (15) of the small flow conduit (12). Further, as described above, since the fitting projection (20) of the valve member (16) is placed in the distal opening (15) of the small flow conduit (12), positioning of the valve member (16) can be performed by the fitting projection (20) so that the central portion of the valve member (16) is always located in the distal opening (15). This makes it possible to prevent the misalignment of the valve member (16) and therefore to always maintain the normal function of the valve member (16). Further, as described above, since the valve member (16) is made of a rubber material, the valve member (16) can be opened even when pressure is only slightly higher on the side of the supply unit.

Further, the valve seat (21) for the valve member (16) is provided over the small flow conduit (12) so as to annularly project from the inner peripheral surface of the flow conduit (11). Therefore, when the aerosol container (2) side pressure becomes higher than the supply unit side pressure, the valve member (16) is moved to a valve seat (21) side by the pressure of a propellant exerted on a supply unit side and is elastically deformed so that, as shown in FIG. 5, the valve member (16) comes into close contact with the valve seat (21). This makes it possible to seal the flow channel (14) of the flow conduit (11) with the valve member (16).

Further, the tubular supply conduit (22) is provided around the outside of the sealing member (1), the valve opening member (4), and the flow conduit (11). More specifically, the sealing member (1), the valve opening member (4), and the flow conduit (11) are inserted into and placed in the lower end portion of the supply conduit (22), and the supply channel (23), which communicates with a supply unit, is formed above the flow conduit (11). The supply conduit (22) provided in such a manner as described above is covered with the tubular cover member (28) provided around the outside of the supply conduit (22).

Herein below, a mechanism for filling a prescribed amount of propellant using the filling device according to this embodiment having such a structure as described above will be described. First, the aerosol container (2) is connected to the filling device in a state where the lower end surface (24) of the sealing member (1) provided in the filling device abuts against the flat surface (26) of the cover (25) located around the outside of the stem insertion hole (35). It is to be noted that certain amounts of a propellant and a liquid concentrate have already been filled into the aerosol container (2) according to this embodiment. Further, a prescribed amount of the filling to be filled into the aerosol container (2) is previously stored in a supply unit (not shown). According to this embodiment, as described above, the propellant is filled into the aerosol container (2) by impact filling, but according to another embodiment, the propellant may be filled into the aerosol container (2) by so-called equilibrium pressure filling in which the propellant is filled into the aerosol container (2) under an equilibrium pressure while the aerosol container (2) is shaken.

As shown in FIG. 5, the tip of the pressing body (36) of the valve opening member (4) provided in the filling device is inserted into the aerosol container (2) through the stem insertion hole (35) by, as described above, connecting the aerosol container (2) to the filling device. As a result, a valve (44) constituting a valve system of the aerosol container (2) is pressed downward by the tip surface (38) of the pressing body (36) of the valve opening member (4). It is to be noted that the outer diameter of the pressing body (36) is made smaller than the inner diameter of the stem insertion hole (35) so that, as described above, the pressing body (36) of the valve opening member (4) can be inserted into the stem insertion hole (35).

Further, the length of the pressing body (36) of the valve opening member (4) is previously adjusted so that the valve (44) can be pressed by the tip surface (38) of the valve opening member (4) when the flat surface (26) of the aerosol container (2) abuts against the lower end surface (24) of the sealing member (1). The stem insertion hole (35) closed by the stem gasket (31) and the valve (44) of the aerosol container (2) is opened by the downward movement of the valve (44) and the elastic deformation of the stem gasket (31) by, as described above, pressing the valve (44) by the tip surface (38) of the valve opening member (4). As a result, as shown in FIG. 5, the valve system of the aerosol container (2) is opened and the flow channel (14) and the inside of the aerosol container (2) communicate with each other through the communicating hole (8) and the communicating recess (10) of the valve opening member (4).

As described above, the valve system can be opened by mechanical operation of the valve opening member (4) by connecting the aerosol container (2) to the filling device according to this embodiment. Therefore, unlike the conventional filling device which opens the valve system only by the pressure of a propellant supplied from the supply unit, a prescribed amount of the propellant can be reliably pressure-filled from the supply unit into the aerosol container (2) in a state where the valve system is kept in an open state irrespective of the pressure of the propellant supplied from the supply unit or the fact that the pressure required to depress the stem (6) is different from aerosol container (2) to aerosol container (2). Therefore, it is possible to prevent variations in the amount of the propellant contained in the aerosol container (2) after filling of the propellant into the aerosol container (2).

Further, as described above, since the valve system is opened by mechanical operation, the propellant supplied from the supply unit can be filled into the aerosol container (2) with little resistance of the spring (32) or the stem gasket (31). Therefore, the propellant supplied from the supply unit can be brought into contact with the liquid concentrate contained in the aerosol container (2) without significantly reducing the pressure thereof. This makes it possible to, even when a liquid concentrate poor in flowability is filled into the aerosol container (2), promote the dissolution of the propellant in the liquid concentrate by the pressure of the propellant.

As described above, since certain amounts of a propellant and a liquid concentrate are previously filled into the aerosol container (2), the pressure in the aerosol container (2) temporarily becomes higher than the supply unit side pressure just after the valve system is opened, and therefore the propellant and the liquid concentrate contained in the aerosol container (2) flow back to the supply unit side. However, during the backflow, as shown in FIG. 5, the valve member (16) provided in the flow conduit (11) is pressed toward the valve seat (21) side by the pressure of the propellant that flows back from the aerosol container (2) side so that the tapered portion (18) of the valve member (16) is elastically deformed and brought into close contact with the valve seat (21). As a result, the flow channel (14) is sealed with the valve member (16), thereby preventing the backflow of the propellant and the liquid concentrate to the supply unit side through the flow channel (14).

If the valve member (16) used in this embodiment is not provided, the liquid concentrate adheres to the inside of the supply channel (23) or the flow channel (14) due to the backflow of the propellant and the liquid concentrate, which is likely to cause a disadvantage that, when the aerosol container (2) is detached from the filling device, the liquid concentrate adhering to the inside of the supply channel (23) spatters and then adheres to the cover (25) or contaminates the surroundings. However, the filling device according to this embodiment is provided with the valve member (16), and therefore such a disadvantage is less likely to occur.

When the propellant is supplied from the supply unit through the supply channel (23) to the aerosol container (2) side, the propellant supplied from the supply unit passes through the flow channel (14) and abuts against the valve member (16). At this time, when the supply unit side pressure is higher than the pressure in the aerosol container (2) by at least 0.02 MPa, as in the case of the first embodiment, the tapered portion (18) of the valve member (16) is elastically deformed toward the small flow conduit (12) side by the supply unit side pressure. As a result of the elastic deformation, the communicating channel (27) is formed between the flow conduit (11) and the valve member (16).

Therefore, the propellant that has been supplied from the supply unit and has passed through the flow channel (14) passes through the valve member (16) and the communicating channel (27) and flows into the small flow conduit (12) through the communicating ports (13) of the small flow conduit (12). Then, the propellant that has flowed into the small flow conduit (12) passes through the communicating hole (8) and the communicating recess (10) of the valve opening member (4) and is filled into the aerosol container (2).

As described above, the filling device according to this embodiment allows the propellant to flow into the aerosol container (2) when the supply unit side pressure is higher than the aerosol container (2) side pressure by at least 0.02 MPa. Therefore, as compared to the conventional filling device that requires a difference between the supply unit side pressure and the aerosol container side pressure of at least about 0.6 MPa to depress the stem during filling of the propellant, the filling device according to this embodiment can reduce the minimum pressure of the propellant required to fill the propellant from the supply unit into the aerosol container (2).

Further, as described above, the resistance of the valve member (16) during filling of the propellant into the aerosol container (2) is very weak. Therefore, the pressure of the propellant supplied from the supply unit is not significantly reduced even after the propellant passes through the valve member (16), which makes it possible to fill the propellant into the aerosol container (2) while adequately maintaining the pressure of the propellant. Therefore, it is possible to effectively fill a prescribed amount of the propellant into the aerosol container (2). Further, it is also possible to allow the propellant to impact on the liquid concentrate contained in the aerosol container (2) at high pressure. This makes it possible to, even when a liquid concentrate poor in flowability is used, promote the dissolution of the propellant in the liquid concentrate by the pressure of the propellant and therefore to fill the propellant into the aerosol container (2) while maintaining the pressure in the aerosol container (2) at an appropriate level without increasing the pressure in the aerosol container (2) more than necessary.

Fourth Embodiment

According to the third embodiment described above, the sealing member (1) is placed around the outside of the valve opening member (4). However, as described above, in the case of using the valve opening member (4) according to the third embodiment, fluid communication between the inside of the aerosol container (2) and the flow channel (14) is achieved only by the communicating hole (8) and the communicating recess (10) of the valve opening member (4). The above-described first and second embodiments are designed to allow aerosol content to flow between the inside of the aerosol container (2) and the flow channel (14) not only through the communicating hole (8) and the communicating recesses (10) of the valve opening member (4) but also through the gap (40) for fluid communication provided between the valve opening member (4) and the stem insertion hole (35), but the above-described third embodiment is not designed to allow aerosol content to flow through the gap (40) for fluid communication. Therefore, when the valve opening member (4) according to the third embodiment is provided, it is not always necessary to provide the sealing member (1) that makes it possible to seal the space between the valve opening member (4) and the stem insertion hole (35) of the aerosol container (2).

Figure 7:
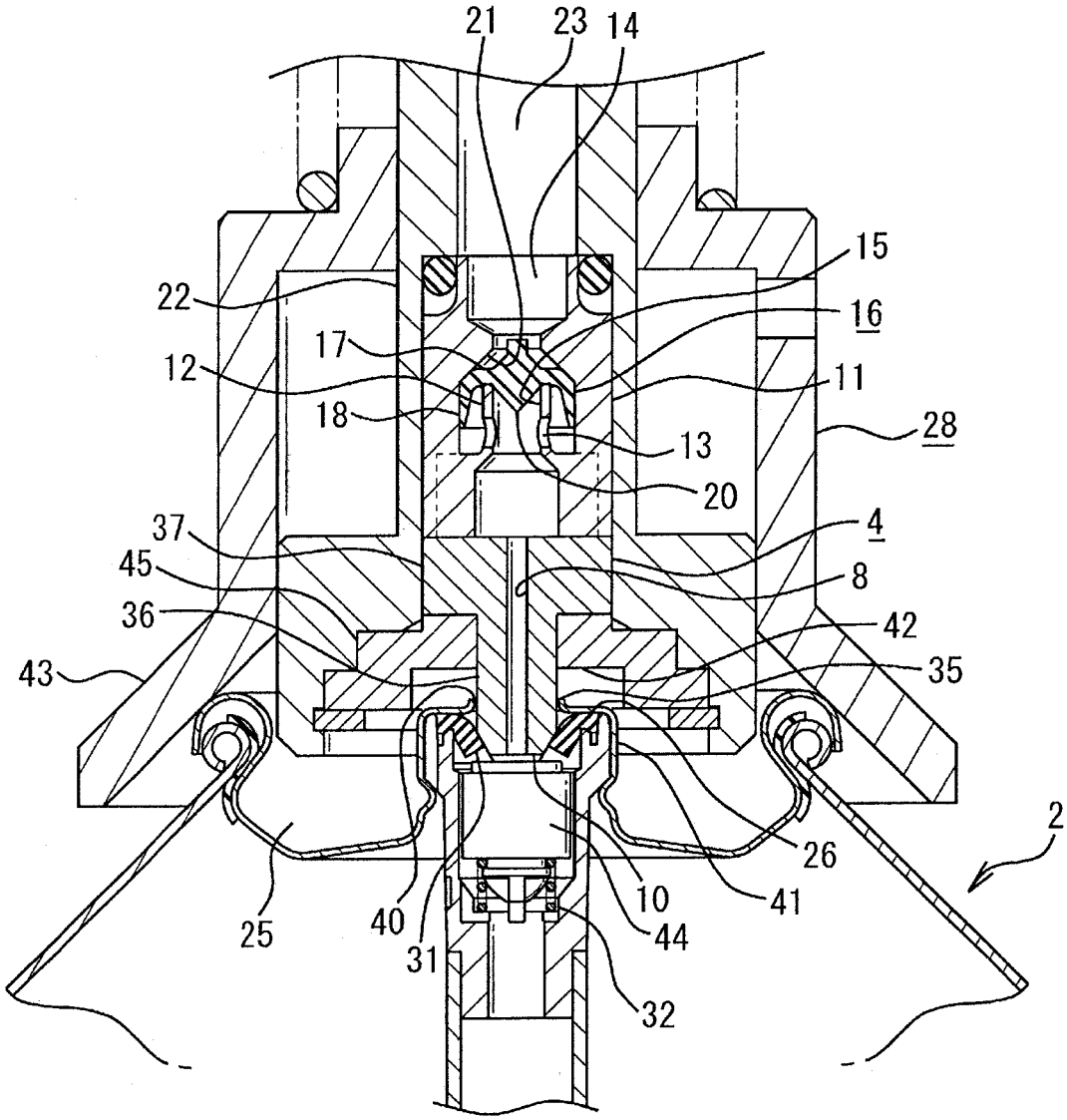
FIG. 7 is a partial sectional view of a fourth embodiment according to the present invention in which an aerosol container side pressure is higher than a supply unit side pressure.
Figure 8:
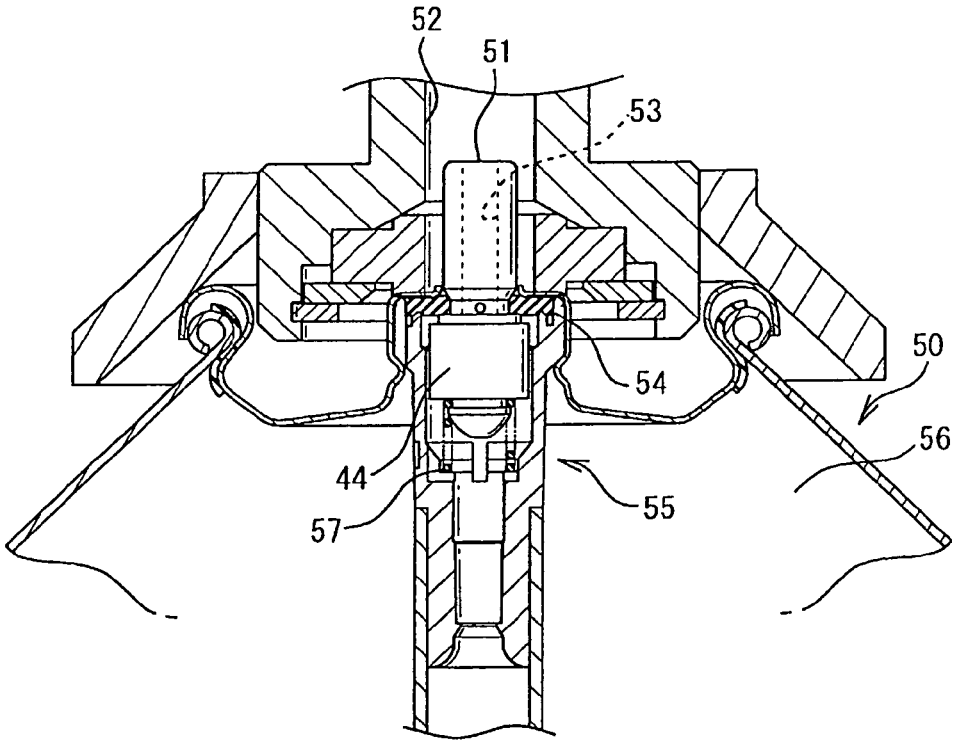
Fig. 8 PRIOR ART
FIG. 8 is a partial sectional view of a conventional filling device.

For this reason, the filling device according to this embodiment is not provided with the sealing member (1) and, as shown in FIG. 7, at the bottom surface of the annular flange (37) of the valve opening member (4), an annular fixed member (45) is fixedly provided in the lower end portion of the supply conduit (22). By fixedly providing the fixed member (45) in the supply conduit (22) with the annular flange (37) in-between in such a manner as described above, the annular flange (37) of the valve opening member (4) is connected and fixed to the inner periphery of the supply conduit (22) between the flow conduit (11) and the fixed member (45). Further, in the bottom portion of the fixed member (45), a bottom-side recess (42) is provided so as to have an inner diameter larger than the outer diameter of a rising portion (41), which is provided in the centre of the cover (25) of the aerosol container (2), in order to avoid the rising portion (41) from abutting against the bottom portion of the fixed member (45).

When, the aerosol container (2) is connected to the filling device according to this embodiment, the outer periphery of the cover (25) of the aerosol container (2) abuts against the inner peripheral surface of a spreading portion (43) provided in the lower end portion of the cover member (28) so as to have a gradually-increasing diameter. At this time, the tip of the pressing body (36) of the valve opening member (4) provided in the filling device is inserted into the aerosol container (2) through the stem insertion hole (35). Therefore, as shown in FIG. 7, the valve (44) constituting a valve system of the aerosol container (2) is pressed downward by the tip surface (38) of the pressing body (36) of the valve opening member (4). Then, as in the case of the above-described third embodiment, the stem insertion hole (35) closed by the stem gasket (31) and the valve (44) of the aerosol container (2) is opened by the downward movement of the valve (44) and the elastic deformation of the stem gasket (31) by, as described above, pressing the valve (44) by the tip surface (38) of the valve opening member (4) so that the valve system of the aerosol container (2) is opened.

Then, fluid communication between the inside of the aerosol container (2) and the flow channel (14) of the flow conduit (11) is achieved by the communicating hole (8) and the communicating recess (10) of the valve opening member (4) by, as described above, opening the valve system. This allows aerosol content to flow from the flow channel (14) to the inside of the aerosol container (2) or from the inside of the aerosol container (2) to the flow channel (14), which makes it possible to effectively fill the propellant into the aerosol container (2).

The invention claimed is:

1. A propellant filling device for filling a propellant into an aerosol container, which contains a liquid concentrate and the propellant previously filled thereinto, through a valve system provided in the aerosol container, comprising:

a valve opening member provided in a lower end portion thereof so as to face the valve system of the aerosol container to continuously press a valve member of the valve system to open the valve system;

a communicating hole provided in the valve opening member so as to be able to communicate with an inside of the aerosol container when the valve system is opened;

a flow conduit provided on an upper end side of the valve opening member so as to communicate with a propellant supply unit through a supply channel; and a valve member provided in the flow conduit to allow, when the propellant flows under pressure from the supply unit to the aerosol container, a flow channel of the flow conduit to be opened by a pressure of the propellant and to allow, when the propellant flows under pressure from the aerosol container to a supply unit side, the flow channel of the flow conduit to be closed by a pressure in the aerosol container, wherein the valve system of the aerosol container is kept in an open state by continuously pressing the valve member of the aerosol container by the valve opening member, and in this open state, when an aerosol container side pressure is higher than a supply unit side pressure, backflow of an aerosol content from the inside of the aerosol container to the supply unit side is prevented by the valve member, and when the supply unit side pressure is higher than the aerosol container side pressure, the propellant flows from the supply unit into the aerosol container through the valve member and the valve system; and further comprising:

a small flow conduit provided in the flow conduit in such a manner that a gap is provided between an inner peripheral surface of the flow conduit and the small flow conduit to allow the flow channel of the flow conduit and the communicating hole of the valve opening member to communicate with each other through the small flow conduit;

wherein the small flow conduit has a communicating port provided in its side wall so as to communicate with the flow channel and a distal opening covered with the valve member; and wherein, during filling of the propellant from the supply unit into the aerosol container, when the aerosol container side pressure is higher than the supply unit side pressure, the valve member comes, by the aerosol container side pressure, into contact with a valve seat provided on an inner surface of the flow conduit to allow the flow channel of the flow conduit to be closed to prevent backflow of the propellant and the aerosol content to the supply unit side, and on the other hand, when the supply unit side pressure is higher than the aerosol container side pressure, the valve member is moved to a small flow conduit side by a pressure of the propellant supplied form the supply unit so that a propellant communication channel is formed between the inner peripheral surface of the flow conduit and the valve member to allow the propellant supplied from the supply unit to flow to an aerosol container side through the valve member and the communicating port.

2. The propellant filling device according to claim 1, wherein the valve member is formed from an elastic member having a bowl shape, and wherein:

when the aerosol container side pressure is higher than the supply unit side pressure, the valve member comes into contact with the valve seat of the flow conduit to allow the flow channel of the flow conduit to be closed; and when the supply unit side pressure is higher than the aerosol container side pressure, the valve member is elastically deformed toward the small flow conduit side to allow a propellant communication channel to be formed between the inner peripheral surface of the flow conduit and the valve member.

3. The propellant filling device according to claim 1, wherein the valve member has a flat plate shape, and wherein:

when the aerosol container side pressure is higher than the supply unit side pressure, the valve member comes into close contact with the valve seat of the flow conduit to allow the flow channel of the flow conduit to be closed; and when the supply unit side pressure is higher than the aerosol container side pressure, the valve member is moved to the small flow conduit side to allow a propellant communication channel to be formed between the inner peripheral surface of the flow conduit and an outer periphery of the valve member.

* * * * *